US006146773A

United States Patent [19]

Kaule

[11] Patent Number: 6,146,773

[45] **Date of Patent: *Nov. 14, 2000**

[54] SECURITY DOCUMENT AND METHOD FOR PRODUCING IT

[75] Inventor: Wittich Kaule, Emmering, Germany

[73] Assignee: Giesecke & Devrient GmbH, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/660,854

[22] Filed: Jun. 10, 1996

[30] Foreign Application Priority Data

Jun. 9, 1995 [DE] Germany ..... 195 21 048

[51] Int. Cl.[7] ..... H01F 1/00

[52] U.S. Cl. ..... 428/611; 428/692; 428/694; 428/900; 427/128; 427/130; 427/131; 235/493; 283/82

[58] Field of Search ..... 428/611, 692, 428/694 TM, 694 BM, 900; 427/128, 130, 131; 235/493; 283/82

[56] References Cited

U.S. PATENT DOCUMENTS

| | | | |
|---|---|---|---|
| 4,081,132 | 3/1978 | Pearce | 235/493 |
| 4,114,029 | 9/1978 | Lee | 235/449 |
| 4,183,989 | 1/1980 | Tooth | 428/195 |
| 4,281,043 | 7/1981 | Deffeyes | 428/457 |
| 4,536,229 | 8/1985 | Jin et al. | 148/31.55 |
| 4,743,890 | 5/1988 | Hilzinger et al. | 340/551 |
| 4,756,557 | 7/1988 | Kaule et al. | 283/85 |
| 4,956,636 | 9/1990 | Sansom et al. | 340/551 |
| 5,143,583 | 9/1992 | Marchessault et al. | 162/138 |
| 5,182,062 | 1/1993 | Lee et al. | 264/129 |
| 5,354,099 | 10/1994 | Kaule et al. | 283/85 |
| 5,480,685 | 1/1996 | Suzuki et al. | 427/548 |
| 5,516,153 | 5/1996 | Kaule | 283/85 |
| 5,614,824 | 3/1997 | Dames et al. | 324/239 |
| 5,631,039 | 5/1997 | Knight et al. | 427/7 |
| 5,643,686 | 7/1997 | Isshiki et al. | 428/694 BM |

FOREIGN PATENT DOCUMENTS

| | | |
|---|---|---|
| 41 01 301 | 7/1992 | Germany . |
| 1127043 | 9/1968 | United Kingdom . |

*Primary Examiner*—Stevan A. Resan
*Attorney, Agent, or Firm*—Mayer, Brown & Platt

[57] ABSTRACT

The invention relates to a security document, in particular a bank note, identity card or the like, provided with a magnetic security element. The security element preferably consists of a carrier foil having applied thereto a magnetic material whose coercivity is between 10 and 250 oersteds (Oe).

19 Claims, 1 Drawing Sheet

SECURITY DOCUMENT AND METHOD FOR PRODUCING IT

BACKGROUND OF THE INVENTION

This invention relates to a security document, in particular bank note, identity card or the like, having a security element provided at least partly with a magnetic material, as well as to a method for producing the security document.

Security documents with magnetic materials disposed on or in the document have been known for some time. The magnetic materials can be for example applied in the form of stripes or disposed on separate carrier materials which are in turn firmly connected with the document.

Such a security document is known for example from DE-PS 16 96 245. This print discloses a method wherein a suitable carrier material such as silk, cotton or plastic is provided with a magnetic coating mixture and subsequently embedded in a security document. The security document can be clearly identified mechanically by the incorporated security element, in particular an incorporated security thread.

DE 41 01 301 furthermore discloses a security document having an incorporated magnetic security element wherein the magnetic coating has soft-magnetic pigments. These light gray to silver pigments are admixed to a suitable varnish and spread with it onto a carrier material and subsequently embedded in the security document so that the incorporated magnetic security element hardly appears by reflected light.

Security documents having magnetic security elements can be tested for instance, as described in DE 27 54 267 C3, by measuring the coercivity of the element.

Up to now one has mostly used commercial iron oxides in security documents as are also applied in audiotape and video technology. These are usually $Fe_3O_4$ with a coercivity in the range of from approx. 350 to 1000 Oe, this medium coercivity guaranteeing relatively simple magnetizability and simultaneously sufficient permanent magnetization. Forgeries of security documents which simulate the impression of an authentic security thread using commercial audiotapes are therefore not excluded.

The problem of the present invention is thus to propose a security document and method for producing it which has a magnetic material whose magnetic properties are designed so that they are difficult to imitate.

SUMMARY OF THE INVENTION

This problem is solved according to the invention by the features stated in the independent claims.

The basic idea of the invention is to use a carrier as a security element which has been coated with a defined, low-coercive magnetic layer. Because of their low coercivity and resulting fast demagnetization even under the influence of weak fields, such magnetic layers allow no permanent data storage but have the advantage over conventional medium-coercive magnetic coatings that they are unusual in trade. Since the coercivity of a material can be adjusted independently of other magnetic values, e.g. remanence, it is possible to incorporate the inventive magnetic materials in the document with the magnetic materials differing from those used up to now solely by the value of coercivity. This involves the advantage that the usual properties of the magnetic material, for example remanence, can be measured with all existing standard sensors, while the low and preferably defined coercivity of the magnetic material is detectable solely with special sensors as an additional protective effect. It is thus virtually impossible to imitate the novel magnetic security element in the document.

According to a preferred embodiment one uses as a magnetic material iron which is vapor-deposited on a carrier. The desired coercivity of the applied iron layer can be adjusted via the production parameters independently of its thickness. For example, if the layer is applied in several separate vapor-depositing steps one obtains a lower coercivity than by continuously vapor-depositing the total layer with the same total thickness. It further holds that the fewer impurities are contained in the material, the lower the coercivity is.

With one and the same total layer thickness and the same magnetic material one can thus adjust different coercivities. The production method can alternatively be carried out in such a way that equal coercivity values are achieved for different total layer thicknesses.

Unlike coercivity, other magnetic properties such as remanence are dependent on the quantity of iron applied and largely independent of the method for producing the layer.

This makes it possible to produce iron layers with the same layer thickness which have uniform remanence but different coercivities. Conversely, one can also apply coatings which have uniform coercivity but different layer thicknesses and thus different remanences.

This fact involves the advantage that the data carrier with the inventive magnetic material can first be examined with standard sensors for example as to whether magnetic materials are present in the data carrier which have sufficient remanence. Subsequently one can check whether the magnetic material has the coercivity value necessary for authenticity detection.

Alternatively it is also within the scope of the invention to use crystalline, powdery low-coercive materials which can be mixed into a binder and printed.

BRIEF DESCRIPTION OF THE DRAWINGS

Further embodiments and advantages will be explained with reference to the following figures, in which.

DESCRIPTION OF THE PREFERRED EMBODIMENTS

Figure 1:
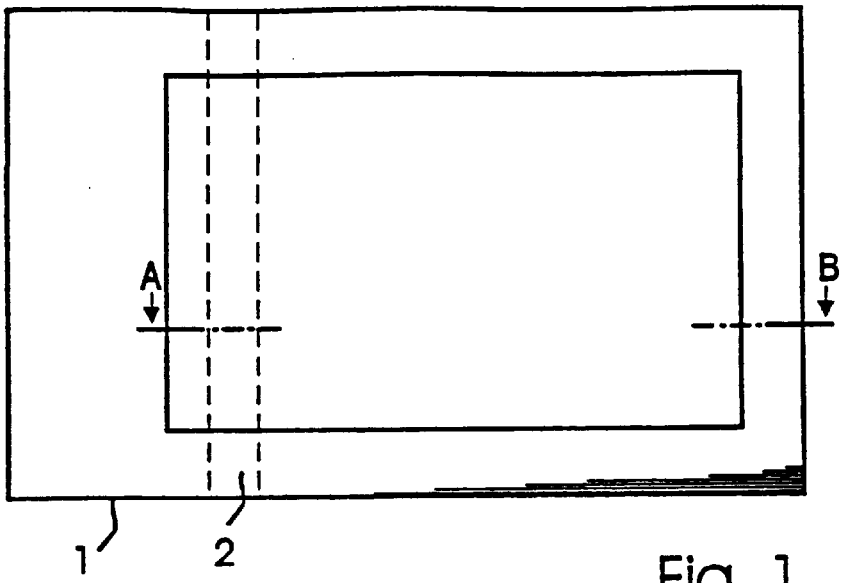
FIG. 1 shows a security document with an embedded security element.

FIG. 1 shows bank note 1 with an embedded security thread according to the invention. The thread is embedded completely inside the paper, which is indicated by the dotted line. However it is likewise possible to have the thread pass to the surface of the bank note in partial areas or completely, resulting in a so-called window security thread. Furthermore one can also incorporate the security element in the security document in the form of planchets or mottling fibers at certain places in the security document.

Figure 2:
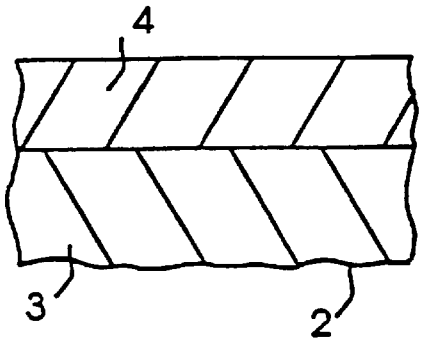
FIG. 2 shows a security thread with a low-coercive magnetic layer in cross section.

The inventive security thread is shown in FIG. 2 in cross section along intersection A-B. Applied to carrier 3, which usually consists of a plastic material, is magnetizable iron layer 4 having a coercivity of 100 Oe. However magnetizable layer 4 can also consist of nickel or a magnet alloy. The only condition is that the coercivity of the layer is between approx. 10 and approx. 250 Oe, preferably between 20 and 150 Oe. The thickness of the magnetizable layer has substantially no influence on coercivity and can be adjusted between 0.05 and 1 microns with the usual choice of process parameters.

In accordance with the applied layer thicknesses and depending on the material used, the remanences adjusted in this procedure preferably have values between 100 and 1000 $nWb/m^2$.

For producing the inventive security thread the magnetizable material, for example iron, is vapor-deposited in single layers in a plurality of operations so that the layer thickness of the magnetizable total layer is 0.1 microns. Vapor-depositing the layer in a plurality of separate operations obtains a coercivity of approx. 20 Oe. The remanence is about 150 $nWb/m^2$. Alternatively the coercivity can be varied by varying the process parameters with the same layer thickness, whereby the remanence also remains the same. For this purpose the magnetizable layer is vapor-deposited in one operation in the layer thickness of 0.1 microns, which leads to a coercivity of 100 Oe and a remanence of 150 $nWb/m^2$. The same coercivity of 100 Oe with higher remanence can be produced by increasing the layer thickness to 0.2 microns and doing the vapor-depositing in one operation again, since varying the layer thickness has substantially no influence on coercivity. The remanence, on the other hand, thereby rises to a value of approx. 300 $nWb/m^2$. In this way one can thus selectively produce layers having a uniform coercivity as a common property but different layer thicknesses, while other magnetic properties such as remanence are different for each layer thickness.

The magnetic material can be applied for example by resistance-heated evaporation of pure iron. However the layers can also be produced by anodic arc evaporation or electron beam evaporation. It is likewise possible to use a printable magnetic material which has a suitably low coercivity.

Figure 3:
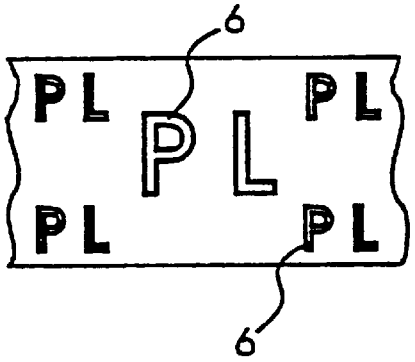
FIG. 3 shows a negative print security thread with a low-coercive coating.

Information such as pictures, logos or characters can be incorporated in the security element by commonly used methods. It can be produced for example by preventing attachment of the magnetic layer in partial areas, or selectively removing the magnetic layer after application so as to produce for example the thread shown in FIG. 3, which was provided with the characters PL. Characters 6 are produced e.g. by locally removing the magnetizable iron layer with the help of a laser beam. However other methods can of course also be used for embedding the negative characters in the thread, such as the methods described in EP 516 790.

Figure 4:
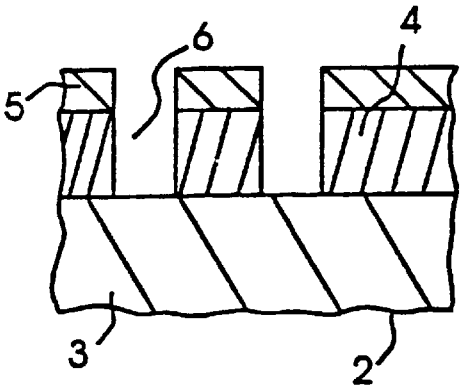
FIG. 4 shows a negative print security thread with a low-coercive coating and a thin metal layer coat in cross section.

To further improve the optical appearance of the thread one can apply thin metal layer 5 over magnetizable layer 4, as shown in FIG. 4. In this connection it is also possible to use colored metal layers, which further improves the appearance of the thread. The additional metal layer, which consists for example of aluminum, can be applied to magnetic layer 4 before incorporation of characters 6 so that when the characters are incorporated metal layer 5 is also removed completely in this area.

Figure 5:
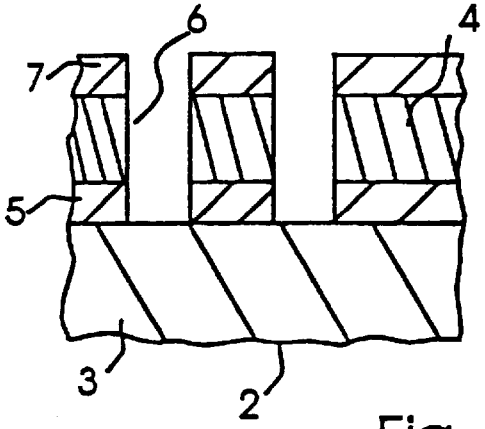
FIG. 5 shows a negative print security thread with a low-coercive coating and two thin metal layer coats in cross section.

FIG. 5 shows a further embodiment of the inventive security element. Applied to carrier 3 is first metal layer 5 to which the magnetizable layer with low coercivity is applied in a further operation. Additionally applied to magnetic layer 4 is further metallic layer 7. The use of two thin metal layers always appears suitable when the thread should show a uniform appearance in the paper by reflected and transmitted light. This measure causes the magnetic layer to be covered from both sides, and the incorporated characters appear clearly from both sides as higher-transparent areas.

By using different metallic materials for covering the magnetic material one can additionally produce color effects which give the security element along with its now continuous conductivity an optically testable security feature. By using copper alloys, for example, one can thus produce golden colors. One can of course produce similar color effects by applying layers of colored translucent lacquer to aluminum.

The above-described information incorporated in the security thread can be present in a positive or negative form. The information can of course also be applied by suitable printing methods, such as microprinting, both on the surface of metallic layer 5 or 7 and on the surface of magnetizable layer 4.

The variants for incorporating characters, pictures or logos in a magnetic thread are very numerous and have been described in EP 516 790. The process variants stated there are also applicable for the inventive data carrier accordingly.

To test the authenticity of the security document having the incorporated or applied security element, one introduces the document into a testing device. When testing the document itself one can first examine it as to whether a magnetizable security element is present. For this purpose one can first determine any magnetic property, measuring e.g. the remanence. The latter should have a minimum value higher than the remanence values of inks usually employed on the data carrier. Such remanence values are preferably higher than 100 $nWb/m^2$. If this test is positive one subjects the security element to a further test for checking whether a certain coercivity value is measurable. By comparing the measured coercivity value with one specific to this document one can prove the authenticity of the document. It is obviously not absolutely necessary to carry out the first step to be able to test the document. What is essential for the particular method applied is only reliable determination of the coercivity value of the security element, whereby it is not even necessary to perform a comparison with any stored values. This is in particular always the case when it is already clear which coercivity value proves the authenticity of the document during measurement.

What is claimed is:

1. A method for producing a security document comprising a security element, said security element comprising a layer of magnetic material, said magnetic material being a crystalline powdery material with a coercivity of between 10 and 250 Oe for a range of remanences, said range of remanences within 100 $nWb/m^2$ to 1000 $nWb/m^2$, said method comprising the steps of:

mixing the crystalline powdery material with a binder to yield a magnetic ink;

printing the magnetic ink at least in partial areas of a carrier; and combining the carrier with a security document.

2. A method for producing a security document comprising a security element comprising a vapor deposited layer or a sequence of vapor deposited layers of a magnetic material for automatic authenticity testing of the document, said magnetic material having a coercivity of between 10 and 250 Oe, said method comprising the steps of:

vapor depositing a first layer of the magnetic material at least in partial areas of a carrier, said first layer having a first thickness;

vapor depositing at least a second layer of the magnetic material onto the first layer, said second layer having a second thickness, wherein the first and second thickness add to a total thickness; and combining the carrier with the security document.

3. The method of claim 2 wherein the total thickness of the magnetic layer is between 0.05 and 1 microns.

4. The method of claim 2 wherein a metal layer is applied above and/or below the first magnetic layer.

5. The method of claim 2 wherein the magnetic layer is applied in the form of readable information.

6. The method of claim 2 wherein the magnetic layer is provided with gaps in the form of readable information.

7. The method of claim 2 wherein the security document further comprises a paper substrate and the carrier is at least partially incorporated into the paper substrate.

8. A security document comprising at least one security element comprising a layer of magnetic material for automatic testing of the document wherein said magnetic material has a single value of coercivity of between 10 and 250 Oe for a range of remanences.

9. The security document of claim 8 wherein said range of remanences is within 100 $nWb/m^2$ to 1000 $nWb/m^2$.

10. The security document of claim 8 wherein the magnetic material is selected from the group consisting of iron, nickel and crystalline powdery materials.

11. The security document of claim 8 wherein said magnetic material is a crystalline powdery material which is mixed into a binder and printed.

12. The security document of claim 8 wherein the layer of magnetic material comprises at least two single layers.

13. The security document of claim 8 wherein the magnetic material is arranged on a carrier which is combined with the security document.

14. The security document of claim 8 wherein the layer of magnetic material further comprises information in positive and negative form.

15. The security document of claim 8 wherein the security document comprises a paper substrate.

16. The security document of claim 15 wherein the carrier is a thread which is at least partially incorporated in the paper substrate.

17. The security document of claim 8 wherein the metal layer is located above and/or below the layer of magnetic material.

18. The security document of claim 17 wherein the metal layer is aluminum or a copper alloy.

19. A security document comprising at least one security element comprising a layer of magnetic material for automatic testing of the document wherein said magnetic material has a single value of coercivity of between 10 and 250 Oe for a range of remanences; wherein said range of remanences is within 100 $nWb/m^2$ to 1000 $nWb/m^2$; wherein the magnetic material is selected from the group consisting of iron, nickel and crystalline powdery materials; wherein said magnetic material is a crystalline powdery material which is mixed into a binder and printed; and wherein the layer of magnetic material comprises at least two single layers.

* * * * *